United States Patent [19]

Nelson

[11] Patent Number: 5,061,146

[45] Date of Patent: Oct. 29, 1991

[54] ENVELOPE OPENER AND LOAD SEPARATOR

[75] Inventor: Larry L. Nelson, Sacramento, Calif.

[73] Assignee: Systems Mailing Research, Inc., Folsom, Calif.

[21] Appl. No.: 468,338

[22] Filed: Jan. 22, 1990

Related U.S. Application Data

[60] Division of Ser. No. 229,880, Aug. 8, 1988, Pat. No. 4,921,388, which is a continuation of Ser. No. 882,333, Jul. 7, 1986, abandoned.

[51] Int. Cl.[5] ..... B43M 7/02

[52] U.S. Cl. ..... 414/412; 83/912; 271/224; 271/147; 53/386.1

[58] Field of Search ..... 414/411, 412, 416; 53/381 R, 386, 569; 83/912, 408; 271/2, 224, 223, 147

[56] References Cited

U.S. PATENT DOCUMENTS

| | | | |
|---|---|---|---|
| 2,172,519 | 9/1939 | Reeder | 271/147 |
| 3,301,116 | 1/1967 | Owen | 83/912 X |
| 4,016,708 | 4/1977 | DeHart | 53/386 X |
| 4,142,430 | 3/1979 | Long et al. | 83/23 |
| 4,664,368 | 5/1987 | Bouwens et al. | 271/224 X |

FOREIGN PATENT DOCUMENTS

| | | | |
|---|---|---|---|
| 742531 | 9/1966 | Canada | 414/411 |
| 155573 | 12/1979 | Japan | 271/224 |

*Primary Examiner*—Frank E. Werner
*Attorney, Agent, or Firm*—Lothrop & West

[57] ABSTRACT

Numbers of similar, loaded envelopes having side edge folds and end edge folds joining two rectangular panels are arranged in a stack in drawer-like portable holder having a side opening. The drawer is installed with the envelopes disposed as a vertical stack in an elevator compartment. An elevator platform at the bottom of the stack is urged upwardly. Each successive top envelope is transferred from the stack to rollers that impel the envelope forcibly against a barrier wall to jog the load against a side edge fold. Cutters sever the other side edge fold and both end edge folds. A vacuum cup moves one of the panels to engage between stripper rollers that draw the entire envelope and the load apart. Conveyors take the separated envelope to a trash receiver and take the load to a receiver tray. There are various electrical driving, timing and performance checking devices, some optically responsive.

4 Claims, 9 Drawing Sheets

42
98
148
104
131
124
111
101
106
108
96
103
91
4
129
114
71
83
84
76
68
73
78
79
21
150
147
141
144
146
143
142
153
158
157
156
159
155
165
161
151
167
164
172
173
174
176
177
178
-1-
-3-
-5-
-6-
-9-
-10-
-12-

FIG-6
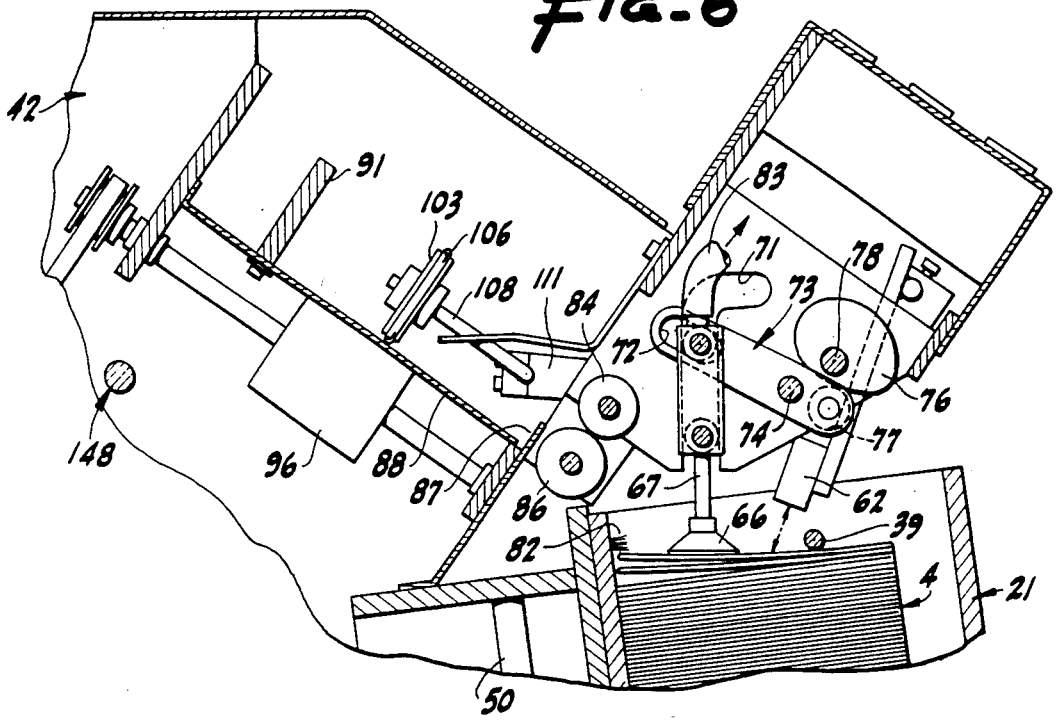
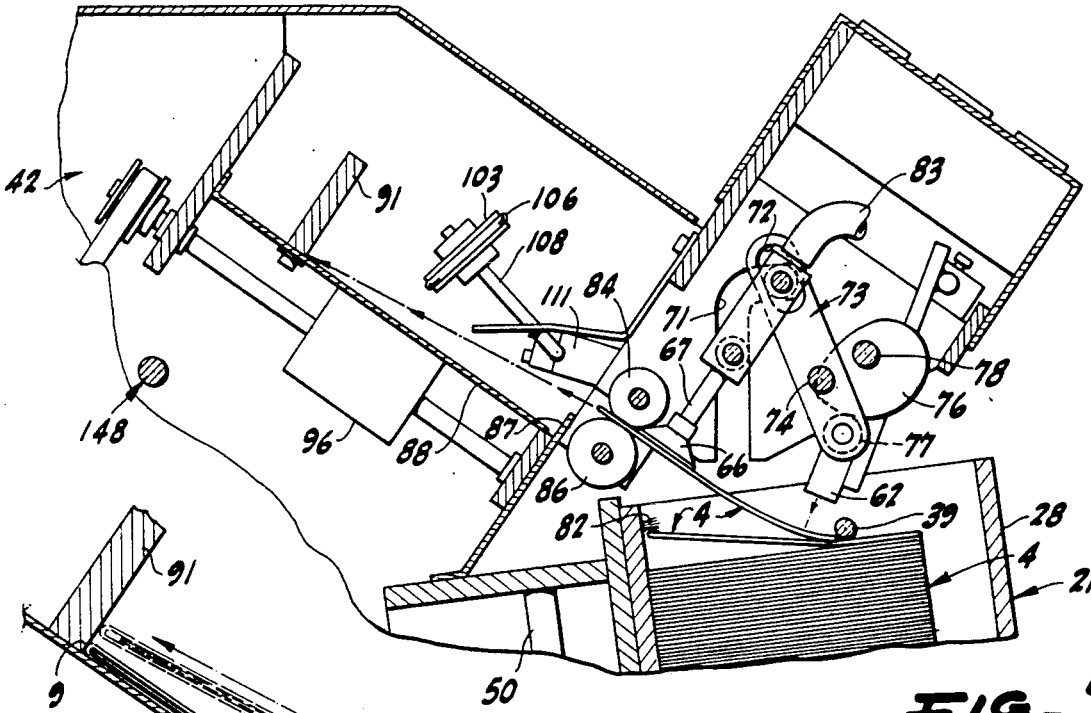
FIG-7
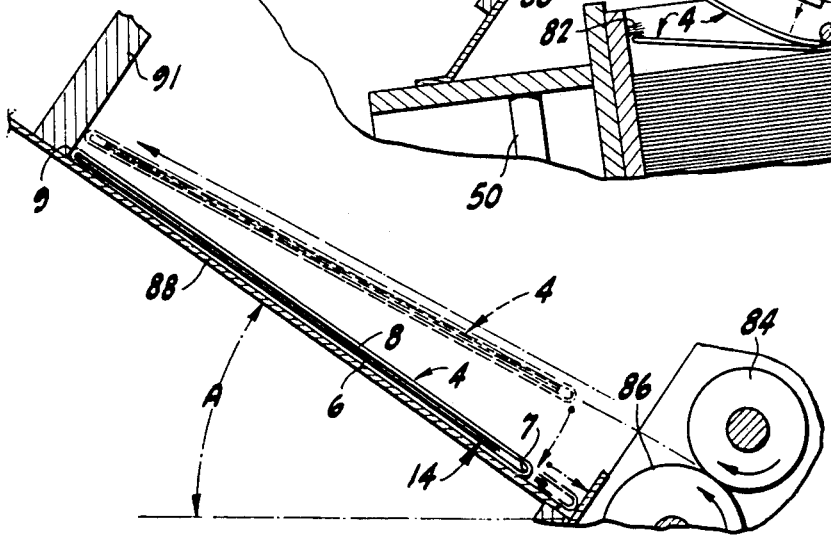
FIG-8

42
186
148
146
88
141
158
144
9
4
129
153
151
152
155
156
157
159
161
162
163
164
165
166
167
168
169
172
173
174
176
177
178
179
181
182
183
184

ENVELOPE OPENER AND LOAD SEPARATOR

This application is a divisional application of Ser. No. 07/229,880, filed Aug. 8, 1988, now U.S. Pat. No. 4,921,388, issued May 1, 1990, which is a continuation of Ser. No. 07/882,333 filed July 7, 1986, now abandoned.

BACKGROUND OF THE INVENTION

A. Field Of The Invention

The disclosure is of a machine for using power for rapidly and automatically opening and removing the contents of a series of sealed, rectangular envelopes.

B. Description Of The Prior Art

The applicant has made no exhaustive investigation of the prior art in this field and makes no representation with respect thereto. The claims are presented as properly defining the novel subject matter herein.

The applicant is familiar with the following United States patents:

| | | |
|---|---|---|
| 3,116,718 | Krupotich et al. | January 7, 1964 |
| 3,384,252 | West | May 21, 1968 |
| 3,884,010 | Bardo et al. | May 20, 1975 |
| 4,016,708 | De Hart | April 12, 1977 |
| 4,123,890 | Russell et al. | November 7, 1978 |
| 4,142,430 | Long et al. | March 6, 1979 |
| 4,295,321 | De Hart et al. | October 20, 1981 |

BRIEF SUMMARY OF THE INVENTION

A device for separating the contents or load from a sealed envelope having two panels joined by side edge folds and end edge folds supports the envelope in a portable, drawer-like carrier. An elevator moves an envelope, as one in a stack in the carrier, to a top position. The top envelope of the stack is taken from the carrier and is sharply impelled against a barrier to drive the load against one of the envelope side edge folds. Cutters then sever the other side edge fold and both end edge folds. Means engaging one of the panels removes both still-joined panels from the load. The joined panels are deposited in a trash receiver, and the load is deposited in a separate load receiving tray. The various moving elements are driven by electric motors and solenoids under manual, electrical and optical control. Inadvertently unseparated envelopes and loads are specially detected an handled.

BRIEF DESCRIPTION OF THE DRAWINGS

FIG. 6 is a view similar to FIG. 5 but with the parts in an advanced position, the plane of section being indicated by the line 6—6 of FIG. 2.

FIG. 7 is a figure similar to FIG. 6 but with the parts in a farther advanced position.

FIG. 8 is a cross-section showing to an enlarged scale a part of the jogging structure of FIGS. 5, 6 and 7.

DESCRIPTION OF THE PREFERRED EMBODIMENT

While the device of the invention can be utilized with a single envelope with load, it is primarily concerned with handling a large number of envelopes with loads; for example, in a public utility payment office wherein large numbers of utility bills are paid by mail, with the received envelopes containing a check or currency and perhaps with a card or perhaps with the original bill. In some offices it has required a great deal of tedious, manual labor to open the received envelopes and to extract and segregate the load in each.

While mail envelopes vary in size and proportions, the current device will accommodate envelopes that are reasonably similar in configuration and dimensions, although changes and adjustments can be made to take care of the range of envelopes received. Also, while substantial variations in thickness of the loaded envelopes can be readily accommodated by the machine, excessively thick envelopes may require some machine adjustments.

Figure 1:
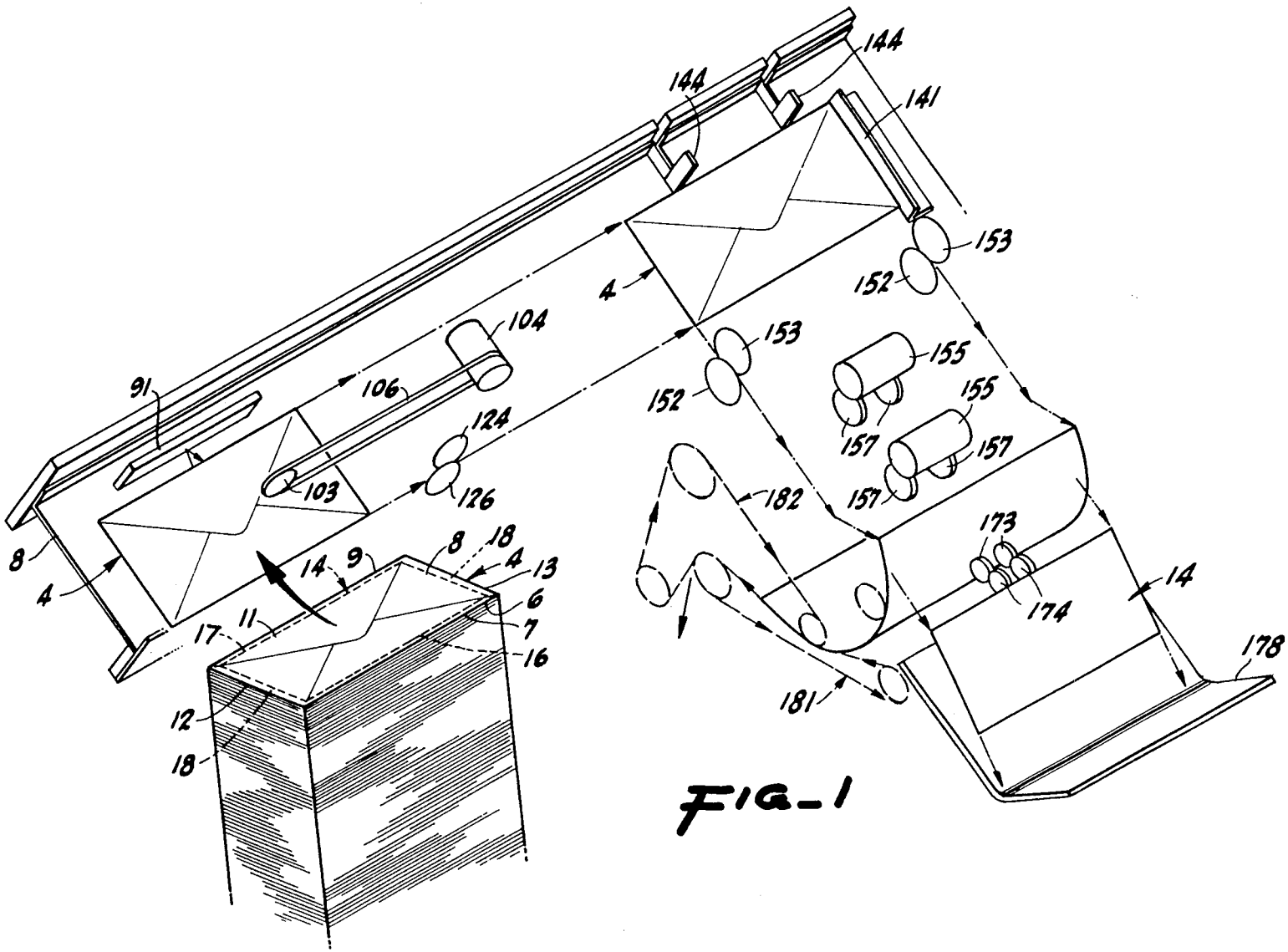
FIG. 1 is an isometric perspective in diagrammatic and schematic form showing the relative arrangement of various portions of the machine.
Figure 4:
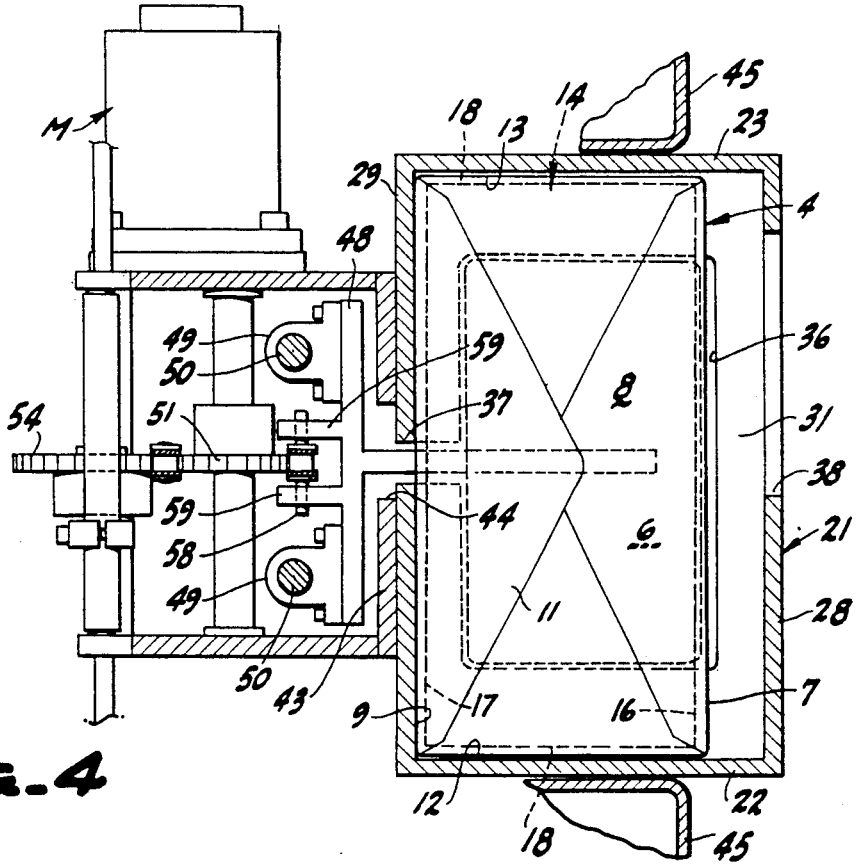
FIG. 4 is a cross-section of the elevator portion of the machine, the planes of section being indicated by the line 4—4 of FIG. 3.

Although the loaded envelopes with which the machine deals may vary somewhat, most of them have the characteristics of the envelope 4 illustrated in FIGS. 1 and 4; that is, a rectangular address panel 6 joined by a stop edge 7 to a sealing panel 8 and joined by a hinge edge 9 to a flap 11 that can be considered part of the sealing panel 8. At one end extremity there is a first end edge 12 and at the other end extremity a second end edge 13. It is customary for the flap 11 to be secured to the rest of the sealing panel 8 by an adhesive, although the flap can be unsecured or can be tucked into the interior of the envelope without affecting the machine operations.

Within the envelope there is normally carried a load 14, usually of rectangular form and slightly smaller than the envelope to space one load edge 16 away from the envelope stop edge 7 and to space the other load edge 17 away from the hinge edge 9. There are customarily spaces 18 between the ends of the load and the ends of the envelope.

Figure 3:
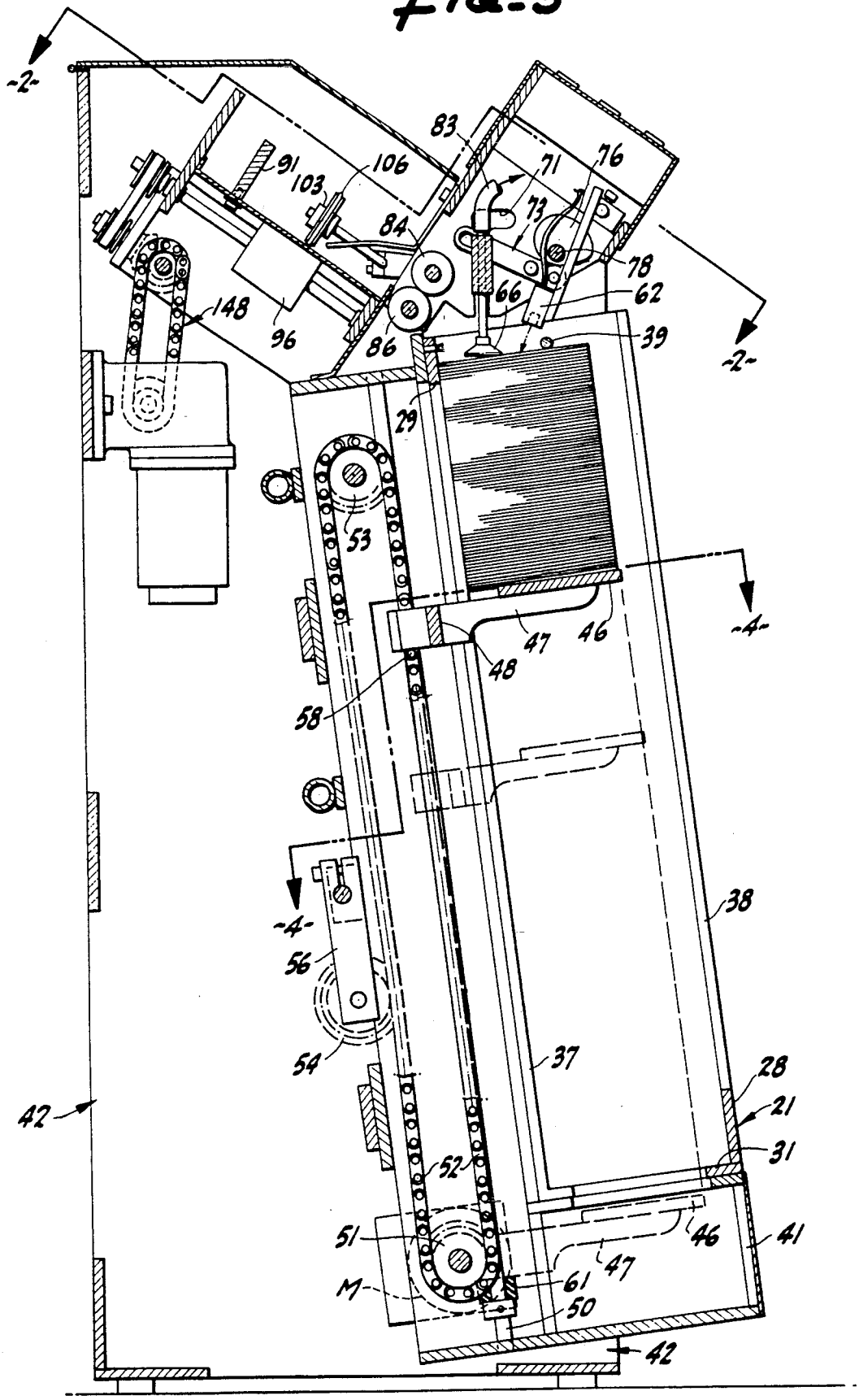
FIG. 3 is a vertical cross-section of the elevator portion of the machine, the planes of section being indicated by the line 3—3 of FIG. 2.

For use in accumulating and transferring groups of loaded envelopes to and into the machine, there is preferably provided, as illustrated in FIGS. 3 and 4, an envelope carrier 21 of generally rectangular form and of light material, inclusive of a pair of side walls 22 and 23, a front wall 28 and a rear wall 29. A bottom wall 31 partially closes the bottom of the carrier and is interrupted by a T-shaped bottom opening 36 having a passageway connecting a rectangular portion of the bottom opening 36 to a longitudinal slot 37 defined between portions of the rear wall 29. The slot 37 extends for nearly the full length of the carrier and is supplemented by a front opening 38 in the carrier front wall 28. This opening likewise extends for almost the entire length of the carrier 21. Extending between the side walls 22 and 23 is a rod 39 serving as a carrying handle for the carrier and as a stop.

In use, the carrier 21 at first is separate from the rest of the machine and is put anywhere at any desired location and attitude. By hand, successive envelopes are stacked in the carrier, beginning at the bottom wall 31 and extending up to about the top end of the slot 37, the topmost or endmost envelope lying fairly close to the stop rod 39. The collected envelopes are positioned without regard to the orientation of the address panel or of the sealing panel and without regard to the end locations.

When it is desired to open the envelopes, the carrier 21 is, as shown particularly in FIGS. 3 and 4, installed on a pedestal 41 (FIG. 3) forming part of the main frame 42 of the envelope opener and load separator device. The pedestal is inclined to the horizontal at a small angle, as is a rear frame wall 43 also forming part of the machine frame and having a vertical slot 44 therein. Rear frame wall 43 further has a forwardly facing inner surface and a rearwardly facing outer surface. The carrier is disposed at the same, envelope-retaining inclination and is supported from the bottom and on three sides. The carrier is accurately positioned and is received between and protected laterally by portions 45 (FIG. 4) of the machine casing or main frame 42. When the carrier 21 is so initially positioned, it rests just above an elevator platform 46 (FIG. 3) having a beam 47 extending through the slots 37 and 44 to a yoke 48 having bosses 49 slidable on elevator rods 50 anchored at the bottom in the machine frame and similarly confined at the top. The elevator platform is thus able to move up and down along the rods 50. The pedestal 41, the rear frame wall 43 and the lateral portions 45 serve as a receiver for the carrier 21, as shown in FIG. 4.

In order to operate the elevator 46, there is provided an electric motor M carrying a drive sprocket 51 (FIG. 3) meshed with a chain 52 extending around an idler sprocket 53 near the top of the elevator mechanism. An adjusting sprocket 54 on a swinging clamp arm 56 maintains the proper tension in the chain 52 in accordance with its setting. Suitably projecting from at least one of the chain links is a cross pin 58 (FIGS. 3 and 4) arranged to abut the nether side of lugs 59 extending from the elevator yoke 48. When the motor M is energized and the chain 52 is correspondingly driven with one run ascending near the rods 50, the pin 58 underrides the lugs 59 and so lifts the elevator platform 46 along the rods 50 from a lower position toward an upper position. The latter is established as the pin 58 rides in an arc with the chain around the top sprocket 53 and withdraws from under the lugs 59. At that juncture the weight of the elevator platform 46 causes it to slide downwardly along the rods 50 by gravity. It is stopped in its lower position against a bumper 61 that supports the elevator platform 46 for a subsequent lifting operation.

The machine is energized and prepared for operation by manual pushing of a start button (not shown). An object detection assembly 62 (see FIGS. 3 and 5), includes a source of light, such as an incandescent bulb, and a companion photo cell, both directed toward the elevator area as shown. The detection assembly 62 is effective to control intermittent application of electrical power to the motor M. When there is no light reflected back to the photo cell from an envelope immediately beneath the cell, the motor M is energized, and the elevator is operated, as are other cooperating structures. In this way, the stack of envelopes in the carrier is pressed upwardly until the uppermost envelope comes into interfering abutment with the cross rod 39. At this point, the reflected light level detected by the photocell is sufficient to trigger associated switching circuitry, causing deactivation of the motor M. After a number of envelopes has been removed from the top of the stack, in a manner as set forth in detail below, the reflected light drops below a predetermined threshold level, causing the motor M to be once again activated, and the stack raised as previously described. In this fashion, the motor M is intermittently actuated to maintain a constant supply of stacked envelopes in the uppermost portion of the elevator, until the stack is exhausted.

Special means are provided for removing the uppermost envelope from the stack. That removal is effective on the stack of envelopes to permit lifting and positioning of the next successive envelope at the top. Thus, the stack is fed incrementally or envelope by envelope farther into the machine, each top envelope then being handled individually. For that purpose, there is particularly provided (see FIGS. 5, 6 and 7) a vacuum cup 66 of a pliant material such as rubber and of generally conical form mounted at the end of a stiff tube 67. While the tube 67 is stiff, the cup 66 is sufficiently flexible and yieldable both in the bell portion and in the neck portion so that the bell can move and yield to meet closely the surface of an envelope even though such surface is not exactly planar and may be somewhat skewed, irregular and rough. The abutment is always well enough made to insure a proper vacuum and adequate holding. The tube is confined to special motion by being mounted in a block 68 carrying rollers 69 movable in L-shaped slots 71 in suitable frame plates. The slots have a substantially vertical portion joined by a curve to a substantially horizontal portion.

The upper roller 69 (FIGS. 6 and 7) is engaged by the walls of a cam slot 72 in a lever 73 mounted on a fulcrum pin 74 for actuation by an ovoid cam 76 engaging a roller 77 mounted on the lever 73. The cam 76 is on a shaft 78 rotated in time with the operation of the machine. As the shaft 78 rotates, it periodically closes a switch 79 and so relates machine element positions to a controlling microprocessor, not shown. Also, as the cam shaft 78 rotates, the cam 76 in engagement with the roller 77 rocks the lever 73 and moves the upper roller 69 in the L-shaped path 71, the lower roller following in the straight path. The vacuum cup 66 is thus moved from a lower most almost vertical position in initial rim engagement with the topmost envelope (FIG. 6) by lifting the envelope 4 upwardly relative to the restraining rod 39 as a fulcrum and past a separating brush 82. The next adjacent, lower envelope is kept back and the upper edge of the top envelope is separately lifted to a position substantially as shown in FIG. 6.

Figure 5:
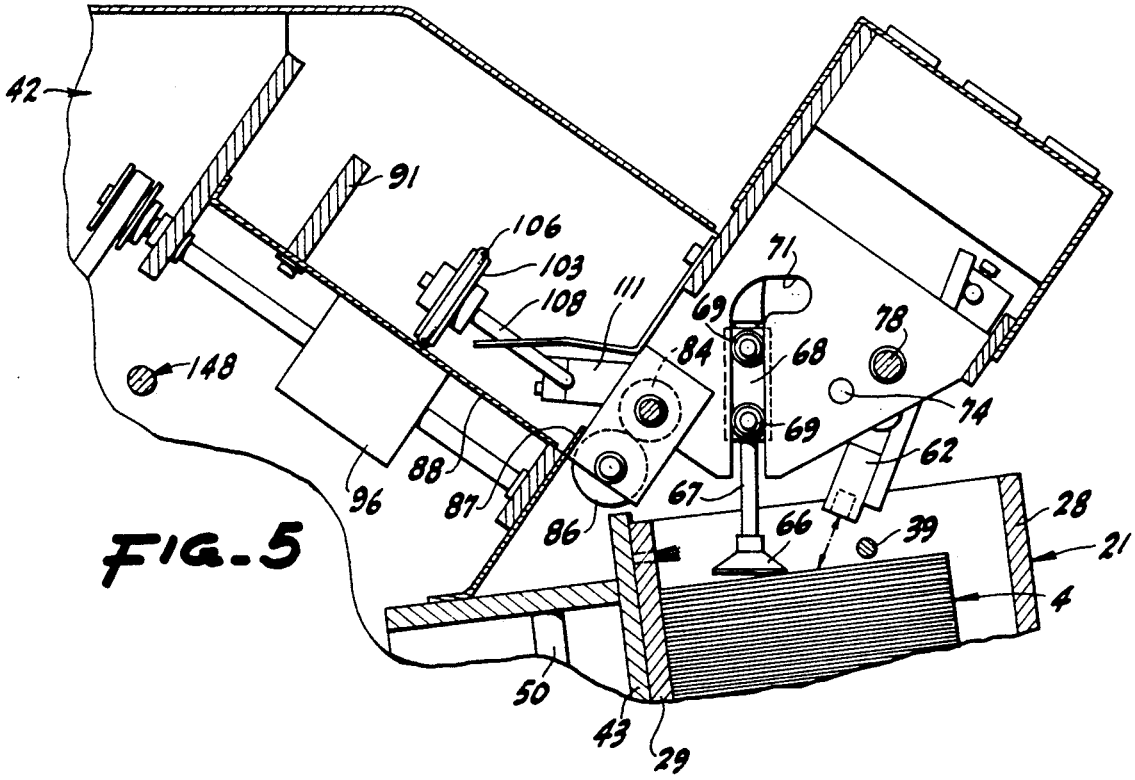
FIG. 5 is a cross-section of the pick-up portion of the machine approaching an envelope, the plane of section being indicated by the line 5—5 of FIG. 2.

The vacuum for the cup is furnished through the stiff tube 67, which extends entirely through the block 68 and is engaged by a flexible hose 83 going to a suitably controlled source of vacuum. As the cup 66 is against the envelope and is about to rise, the timing is such that vacuum is furnished and the topmost envelope is sucked against and moves with the cup as shown in FIGS. 5, 6 and 7. The envelope is not only lifted near one end, but the forces are such that the envelope is also flexed and lifted and translated to interengage between a pair of high-speed rollers 84 and 86. These rollers rotate in opposite directions and grasp the inserted, leading edge of the topmost envelope between them and tend to pull the envelope away from the vacuum cup 66 and from under the rod 39. This motion is permitted by interrupting the vacuum to the vacuum cup 66 just as the envelope has entered between and is well grasped by the rollers 84 and 86. The envelope after being released to the control of the high-speed rollers is directed from between them. It is discharged away from the rollers and over an upstanding ledge 87 at and along the lower margin of a shelf 88 inclined at an angle A to the horizontal (FIG. 8). This angle is sufficiently steep so that any envelope simply dropping onto the shelf 88 will slide downwardly by gravity to lodge against the ledge 87.

When an envelope is discharged from between the high-speed rollers 84 and 86, it is thrown with considerable force against a barrier wall 91 upstanding from the shelf 88 in a position to intercept the thrown envelope. The barrier 91 not only stops the envelope itself, but also permits the loose content, because of its continuing momentum, to shift position within the envelope. The leading edge of the content moves into abutment with the inside of the leading edge of the envelope. The result is to afford substantial space between the trailing edge of the content and the trailing edge of the envelope.

Figure 10:
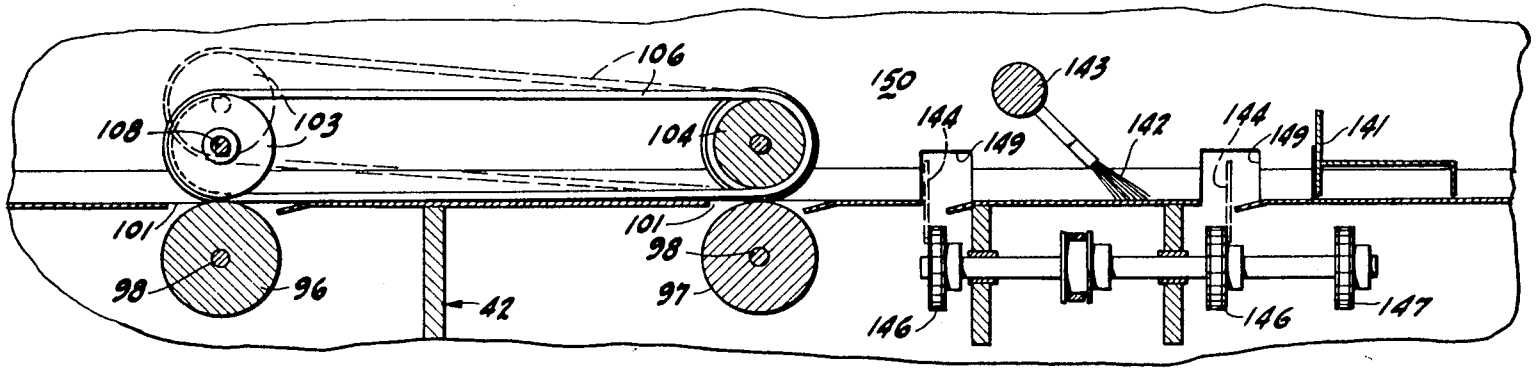
FIG. 10 is a cross-section, the plane of which is shown by the lines 10—10 of FIG. 2.
Figure 11:
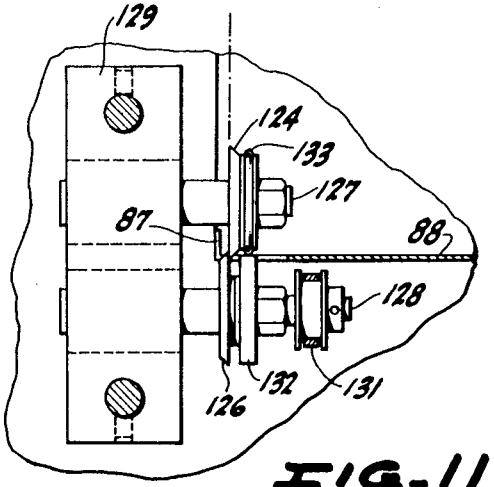
FIG. 11 is a view in the plane indicated by the line 11—11 of FIG. 2 showing a trimming arrangement.

The arrested envelope then drops flat to the plate shelf 88 and slides back to abut the ledge 87. Further processing involves the advancement of the envelope along the shelf 88. To accomplish that (see FIGS. 8, 9, 10, 11 and 12), there are provided suitably driven drums 96 and 97 mounted on driven cross shafts 98 and disposed in gaps 101 and substantially tangent (FIG. 10) to the shelf 88. Supplementing the nether supporting and driving drums 96 and 97 are upper driven pulleys 103 and 104 encompassed by a belt 106 of preferably circular cross-section and usually of rubber or the like. While the pulley 104 simply rotates, the pulley 103, and the belt with it, has a rising and falling motion. As particularly shown in FIG. 9, the pulley wheel 103 is on an axle 108. This extends from an adjustable mounting 109 on a lever 111 having a pivot shaft 112 on the machine frame. At its other end the lever 111 carries a cam follower 113 in the path of an ovoid cam 114 on a drive shaft 78.

Figure 9:
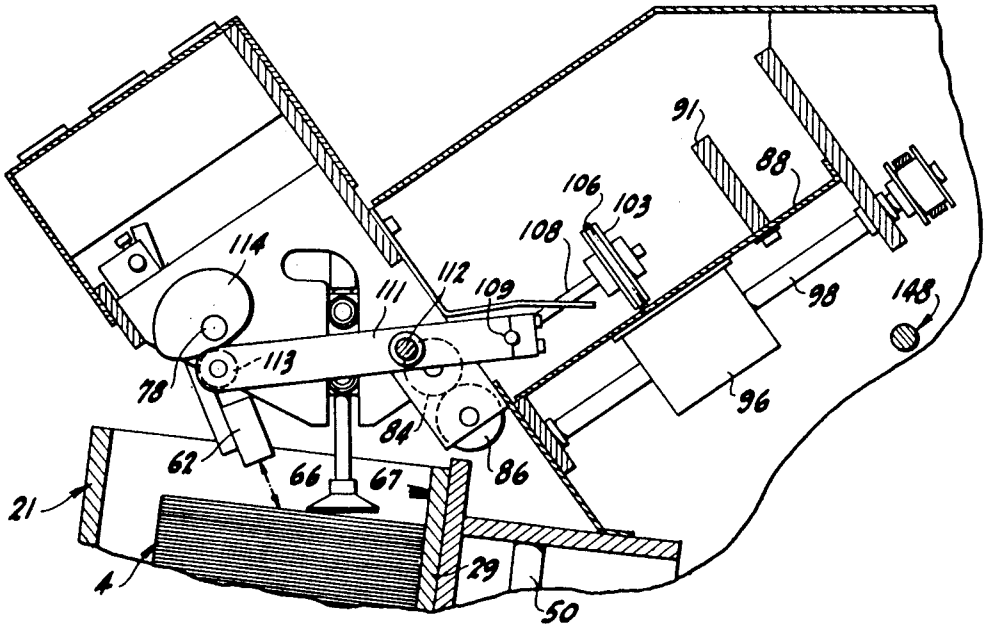
FIG. 9 is a view like FIG. 5 but looking in the opposite direction, as indicated by the line 9—9 of FIG. 2.
Figures 12, 13, 14:
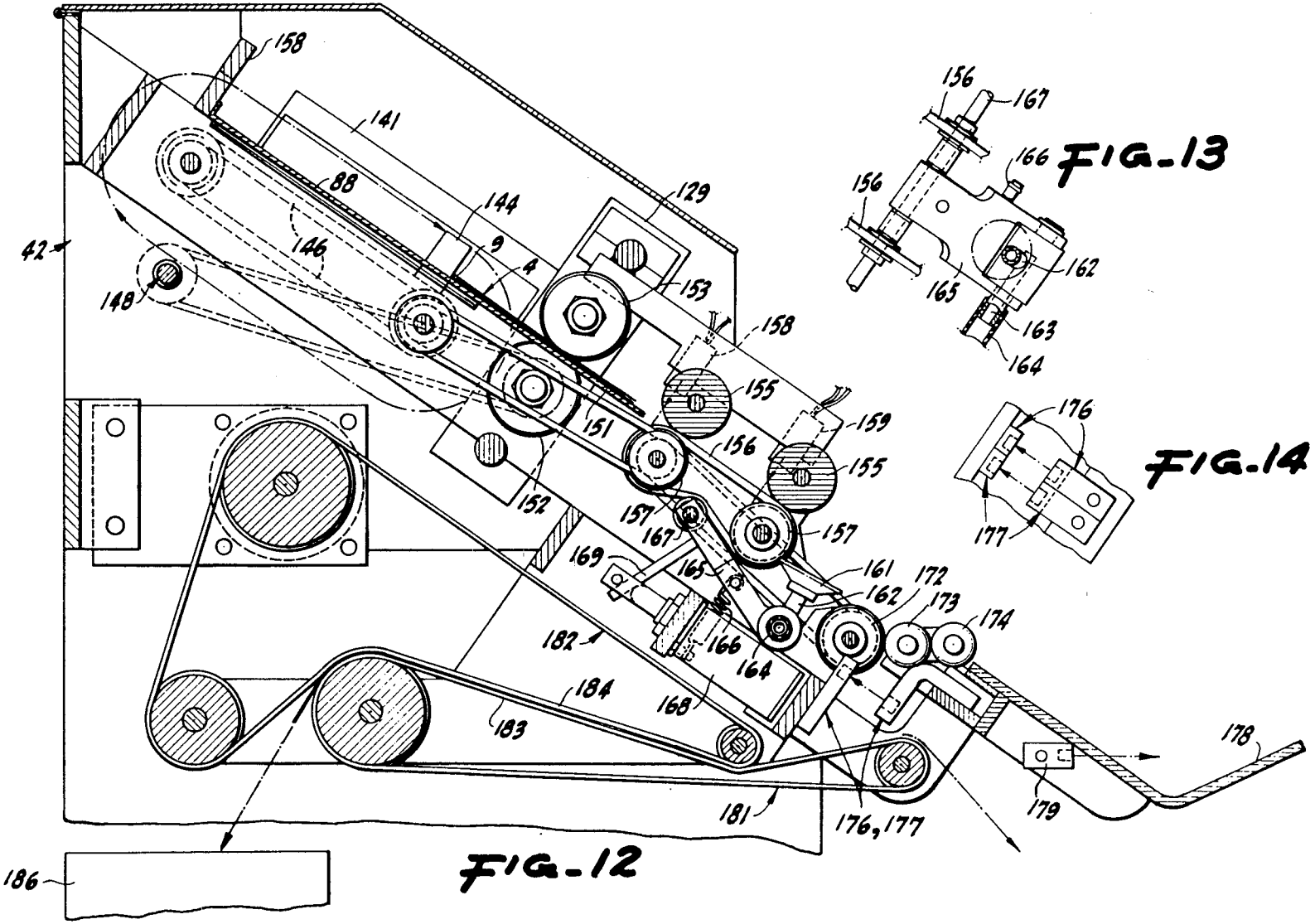
FIG. 12 is a cross-section through the discharge portion of the machine, the plane of which is indicated by the line 12—12 of FIG. 2.
FIG. 13 is a detail showing largely in plan a vacuum cup arrangement disclosed in FIG. 12.
FIG. 14 is a detail showing largely in plan an electro-optical arrangement disclosed in FIG. 12.

As the drive shaft 78 rotates in timed relation with the remainder of the machinery and in a counterclockwise direction in FIG. 9, it periodically depresses the roller follower 113 and rocks the lever 111 about the pivot 112 so that the wheel 103 is lifted and thus lifts most of the belt 106 from a close relationship with the shelf 88. In that fashion the wheel 103 and adjacent portions of the belt are lifted out of the way, as shown in FIG. 7, when the envelope and content are thrown against the barrier 91. Yet, when the envelope has been so thrown and has come to rest on the shelf 88 and against the ledge 87, then the wheel 103 and its surrounding belt lower against the envelope. The envelope and contents in response move longitudinally along and away from the barrier and on the shelf 88 and against the ledge 87, as shown especially in FIGS. 7 and 8.

During the advancement of the envelope and its content away from the vicinity of the barrier 91, and while an envelope edge fold is against the ledge 87, that edge fold of the envelope is severed. This is accomplished by a pair (FIGS. 1 and 11) of knife discs 124 and 126 mounted in shearing relationship to each other on cross shafts 127 and 128 carried in a block 129 on the main frame. The discs are driven by a belt 131 (FIG. 11) on the shaft 128 with the knife 126. The shaft 128 also carries a friction disc 132 in engagement with a drive ring 133 on the shaft 127. Thus the knives 124 and 126 are rotated in shearing relationship as the envelope edge passes between them as it is advanced against the ledge 87.

The operation of the knives removes a small strip of the edge fold of the envelope, thus opening the envelope all along that edge. The envelope continues to advance under the impulse of the driving belt 106 until it abuts a stop wall 141 at the end of the machine opposite the feeding end. The envelope comes to rest on the shelf even though it has been smartly discharged by the belt 106. As the envelope is coming to rest against the wall 141, it is held down in position and is slightly braked (and any static accumulated is removed) by brushes 142 mounted on a bar 143 outstanding from the machine frame.

Figure 2:
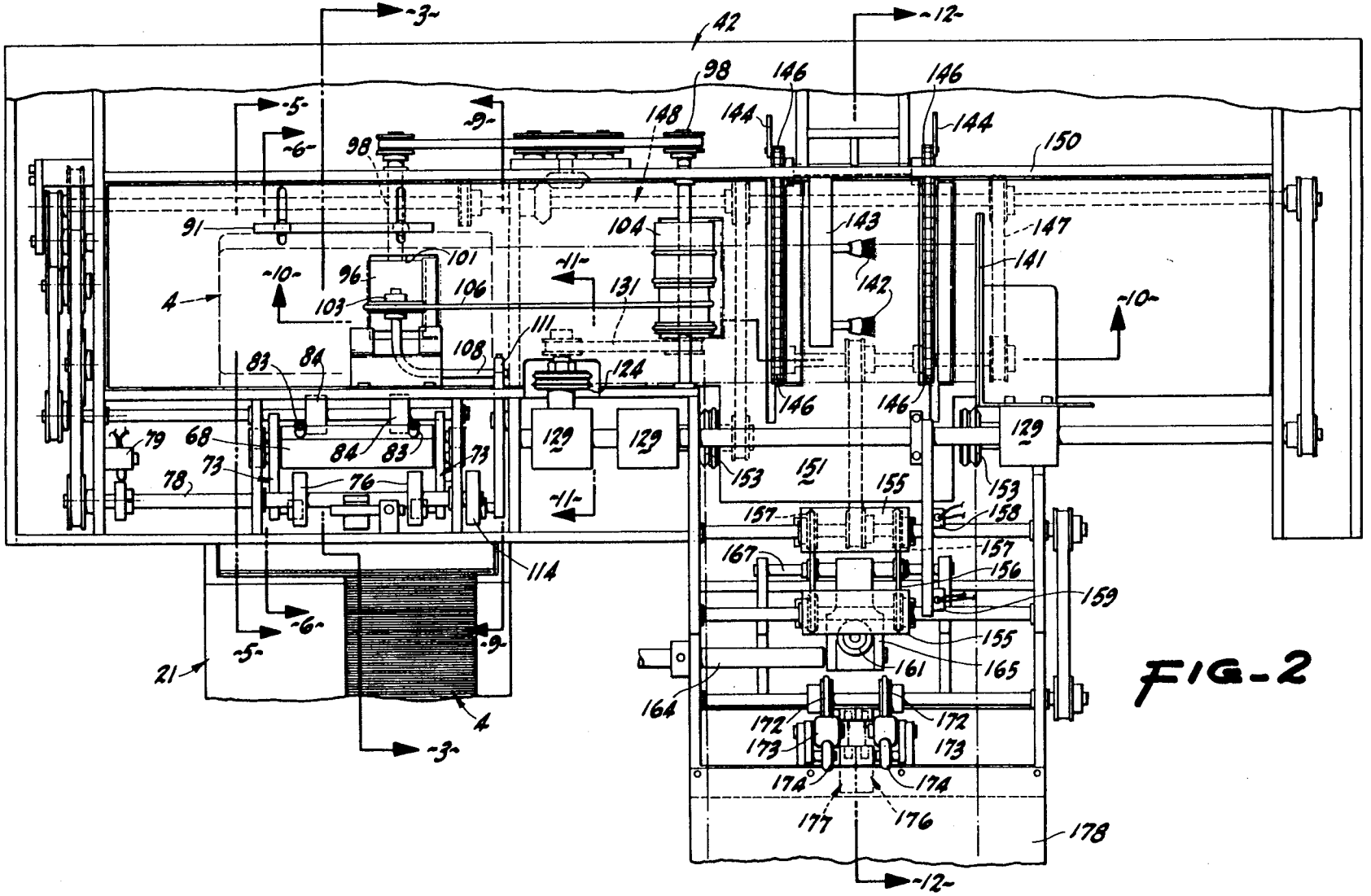
FIG. 2 is a plan of the machine with the covers removed.

The arrested envelope is then advanced in a direction at right angles to the previous direction of advance. This is done (FIGS. 2, 10 and 13) by a pair of upstanding pusher bars 144 secured to a pair of chains 146 trained around sprockets and advanced by a drive chain 147 connected to the principal driving mechanism 148. As the chains 146 advance, the upright bars 144 travel through slots 149 in the back wall 150, encounter the trailing edge of the envelope, and advance the envelope over a supporting plate 151 and between two pairs of end trimming knives 152 and 153. The end knives are appropriately driven and spaced to trim both end edges or end folds simultaneously from the advancing envelope. When this operation has been completed, the envelope is minus three of its edge folds, and its two panels are connected only by the remaining hinge edge 9.

As the envelope continues to be advanced by the pusher bars 144 after its side edge folds have been trimmed, it then travels on round belts 156 trained around rollers 157. These are properly connected to the drive system so that they turn in the same direction (counterclockwise in FIG. 14). They are backed by hold-down drums 155 and act to advance the envelope even farther. The advancing envelope passes beneath a couple of linearly spaced electro-optical detectors 158 and 159. These, with appropriate computer circuitry, measure the rate of advance of the envelope and regulate the handling mechanism accordingly.

Figure 15:
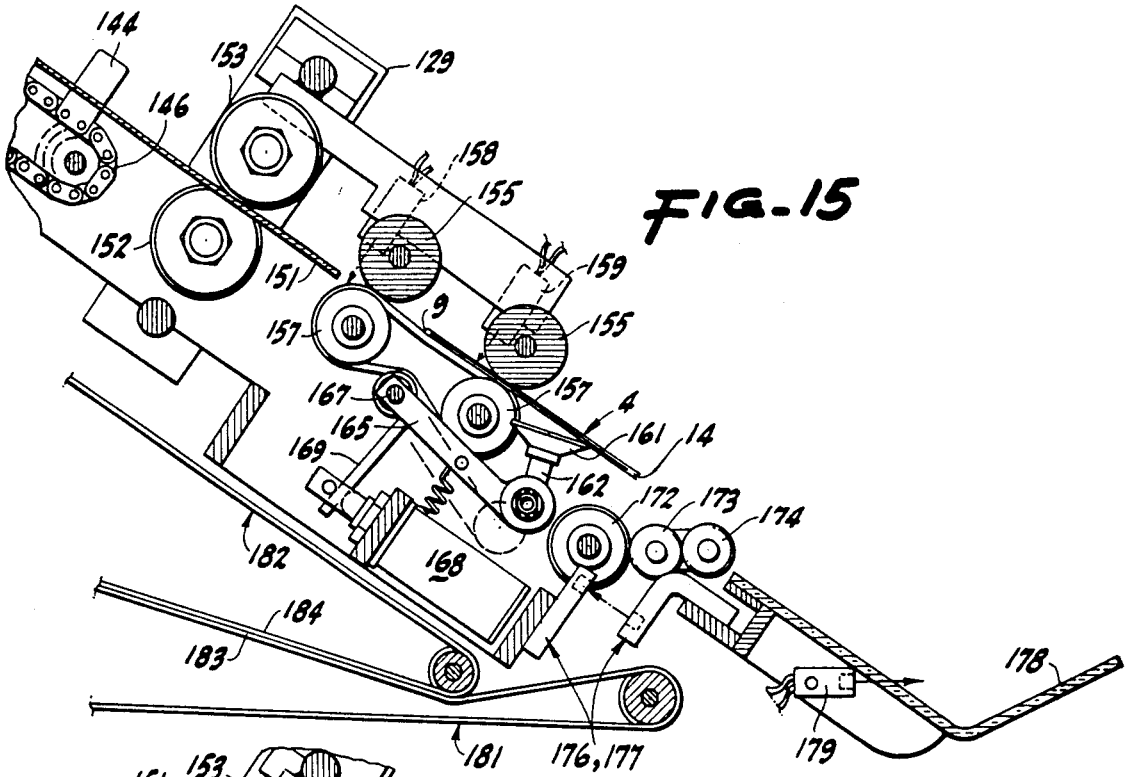
FIG. 15 is a cross-section like FIG. 12 but with some of the parts omitted for clarity.

As the envelope advances rapidly from between the drums 155 and the rollers 157, it overlies a vacuum cup 161 on a tubular stem 162 connected to a cross pipe 163 joined to a flexible hose 164 going to the vacuum source. The cross pipe 163 is journalled in the forked end of a lever 165 urged downwardly by a spring 166 to cause the lever to pivot about a shaft 167. Normally the vacuum cup 161 is out of the path of contact with the advancing envelope 4 until, at the appropriate time, a solenoid 168 is energized and moves an actuating rod 169 secured to the lever 165 and causes the lever to move upwardly in a counterclockwise direction about the shaft 167, thereby tensioning the spring 166. The rotation of the lever 165 not only moves the vacuum cup upwardly but also causes the vacuum cup to rotate from the position shown in FIGS. 12 and 15 into the solid line position shown in FIG. 16 flat against the envelope and spaced back from the leading edge thereof. The vacuum hose 164 engaging the pipe 163 journalled in the lever 165 is otherwise anchored at a distance and acts somewhat as a torsion spring, allowing the vacuum cup to rotate and return within a limited range.

Figure 16:
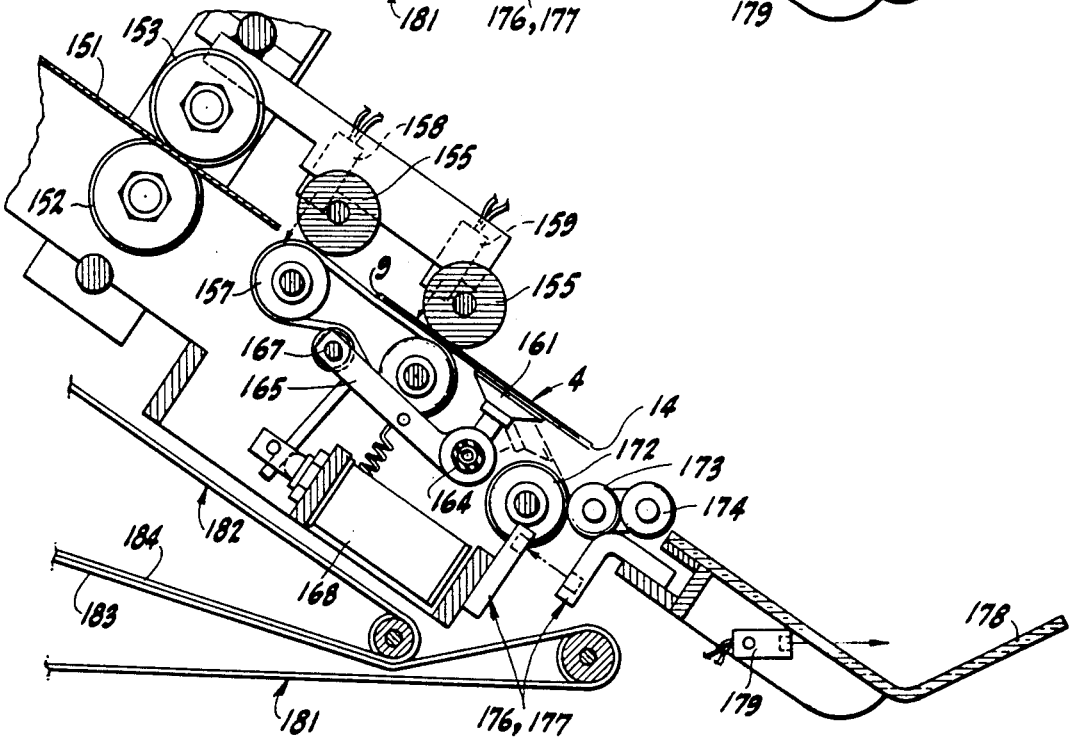
FIG. 16 is a view like FIG. 15, showing the parts in an advanced position.
Figure 17:
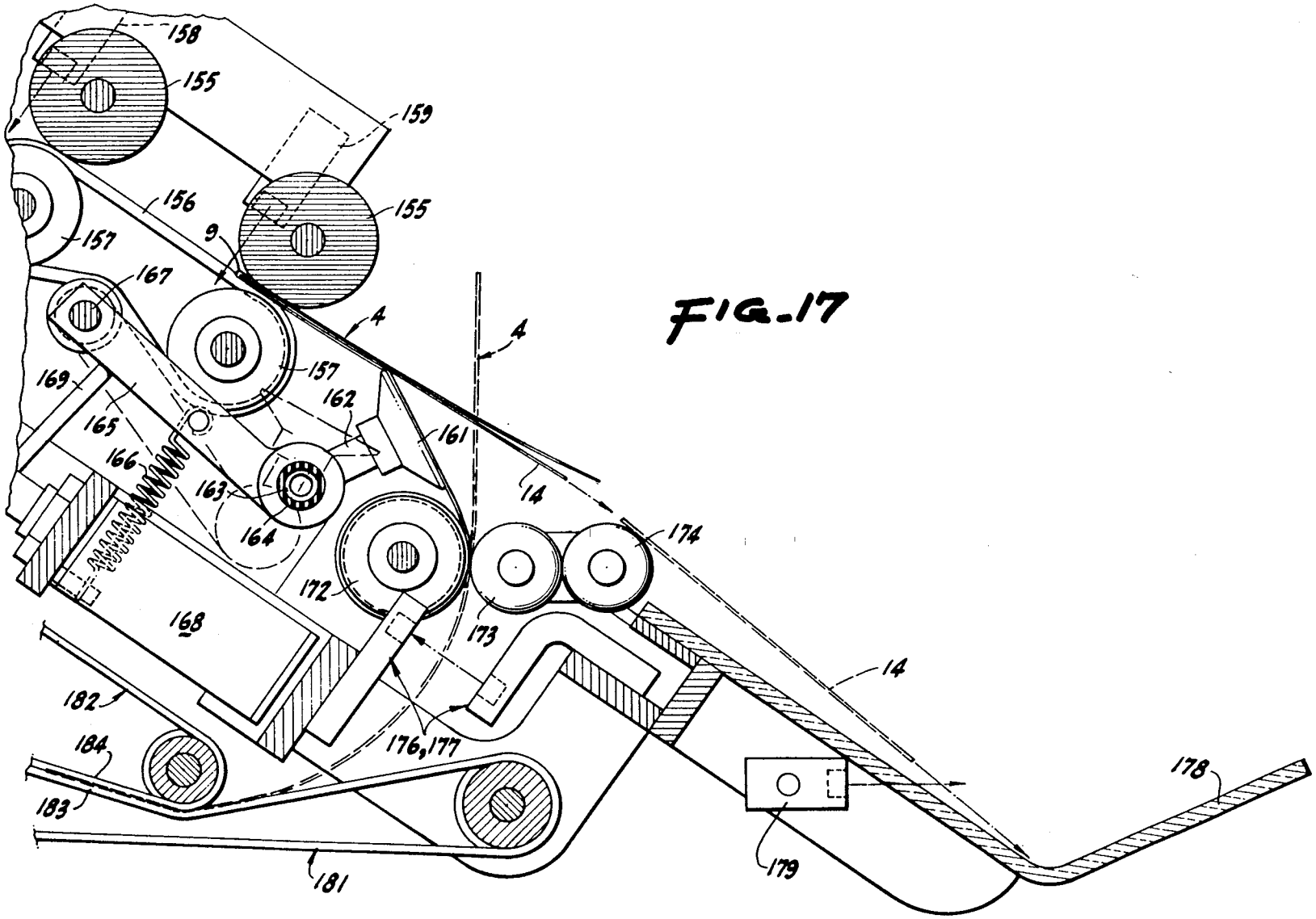
FIG. 17 is a view like FIG. 16 but to an enlarged scale and with the envelope and contents in a farther advanced position.

As the vacuum cup 161 changes its position, it comes into or is drawn into full abutment and full engagement with the envelope 4. As the envelope continues to advance, the vacuum cup and its connections are rotated even farther clockwise, as shown in FIGS. 16 and 17. The envelope bottom panel is moved to enter between pairs of extraction rolls 172 and 173, the latter of which frictionally engages a pair of advancing rolls 174. The rolls 172 and 173 move in opposite directions to each other, and the rolls 173 and 174 also move in opposite directions to each other, with the top of the rolls 174 moving in substantially the same direction as the envelope is advancing.

As the vacuum cup 161 moves to an extreme clockwise position (FIG. 17), the bottom panel of the engaged envelope is diverted and fed forwardly and downwardly between the extraction rolls 172 and 173. The bottom panel 13 is gripped and advanced downwardly between a pair of optical assemblies 176 and 177, each including a light emitting diode and an opposing optical sensor. The content or load from the envelope is left to advance in a straight-ahead fashion. Because of its momentum and general stiffness, the content or load 14 travels over the roller 173 and over the top of the roll 174, perhaps being assisted thereby, and discharges onto a receiving tray 178. The presence of the content on the tray is detected by an optical detector 179 observing through the translucent or transparent material of the tray 178. The operator or supervisor of the machine promptly removes the content from the tray 178 to prevent subsequently arriving content from other envelopes intermixing. Should the supervisor be inattentive and leave content on the tray too long, the detector 179 is effective to stop the machine. After the content has been removed from the tray following such a shutdown, the detector 179 senses the changed condition and initiates an automatic restart of machine operation.

The opened envelope sheet, having been stripped from the contents by being pulled downwardly between the rolls 172 and 173, is moved by the rolls even farther downwardly past the optical assemblies 176 and 177. The envelope is finally deposited on a primary discharge belt 181 operating together with a secondary discharge belt 182, the belt runs 183 and 184 being normally in contact. The envelope sheet between the belts (operating toward the left in FIG. 12), continues to move away from the contents, as shown particularly in FIG. 17, and finally discharges from between the belt runs 183 and 184 into a trash receptacle 186.

If for some reason an envelope and its contents are not properly separated, and both together pass down between the rollers 172 and 173 and the pairs of optical assemblies 176 and 177, the extra opacity of the multiple discharge, namely, the envelope plus the contents, is noted or detected by the optical assembly 176. This extra opacity detection alerts the assembly 177 to sense the passage thereby of an advancing end of the envelope sheet. A time delay is initiated during which the envelope sheet continues on. Since the rate of envelope sheet advance is known from a previous measurement (detectors 158 and 159), an appropriate duration of delay is selected so that the belt runs 183 and 184 are stopped when the envelope and content are about in the location shown in FIG. 12. At that point the drive to the belt runs 183 and 184 is reversed, moving the energized envelope and content toward the right in FIG. 12 and discharging them from the belt run and from the machine for special handling. The machine can then be started in the initial direction, as before.

As the operation continues, finally the elevator has brought the last envelope in the stack to the top of the elevator. The vacuum cup picks it off, as before, and starts it through the cycle. Following the removal of this last envelope, the detector assembly 62 no longer detects reflected light, causing the elevator motor M to actuate while the machine remains running. The elevator motor M continues to raise the elevator platform 46 until the chain pin 58 starts to rotate around the top sprocket 53, slipping from under the lugs 59 on the elevator yoke 48, and allowing the elevator platform to fall downwardly to the initial start and reloading position.

The machine will continue to run from the time the detector assembly 62 saw the last envelope, for three machine cycles, allowing all envelopes in the transport to be processed before stopping completely.

I claim:

1. A device for shifting contents within an envelope having a leading edge folds, a trailing edge fold, and end folds, comprising:

a. a frame;

b. a horizontally extending and transversely inclined shelf on said frame, said shelf having a lower margin, an upper margin, and an upper surface therebetween, an upstanding ledge along said lower margin of said shelf, and a barrier wall upstanding from said shelf along said upper margin;

c. an envelope elevator upright on said frame and having the top thereof adjacent said upstanding ledge, the envelope being delivered to said elevator top with its leading edge fold substantially parallel to said barrier wall; and, d. means on said frame for removing the envelope from said top of said elevator and throwing the envelope over said ledge and above and across said upper surface to impact said leading edge fold against said barrier wall, shifting a leading edge of the contents into abutment with the inside of said leading edge fold and providing a space between a trailing edge of the contents and the inside of said trailing edge fold of the envelope, the envelope thereafter dropping onto said upper surface and sliding downwardly until said trailing edge fold falls against said upstanding ledge.

2. An envelope opener and content separator, for an envelope having a leading edge fold, a trailing edge fold, and end folds, comprising:

a. a frame;

b. a horizontally extending and transversely inclined shelf on said frame, said shelf having a first end, a second end, a lower margin, an upper margin, an upper surface between said margins, an upstanding ledge along said lower margin of said shelf, and a barrier wall upstanding from said shelf along said upper margin;

c. an envelope elevator upright on said frame and having the top thereof at said first end of said shelf and adjacent said upstanding ledge, the envelope being delivered to said elevator top with its leading edge fold substantially parallel to said barrier wall;

d. means on said frame for removing the envelope from said top of said elevator and throwing the envelope over said ledge and above and across said upper surface to impact said leading edge fold against said barrier wall, shifting a leading edge of the contents into abutment with the inside of said leading edge fold and providing a space between a trailing edge of the contents and the inside of said trailing edge fold of the envelope, the envelope thereafter dropping onto said upper surface and sliding downwardly until said trailing edge fold falls against said upstanding ledge;

e. first means on said frame along said upstanding ledge and between said first end and said second end of said shelf, for severing said trailing edge fold of the envelope;

f. first means on said frame for advancing the envelope in a first direction from said first end past said severing means to said second end of said shelf;

g. second means on said frame for severing the end folds of the envelope, said second severing means being oriented along a second direction at right angles to said first direction;

h. an envelope content separating station on said frame, including means for grasping a panel of the envelope and removing it from the content moving along said second direction;

i. second means on said frame for advancing the envelope in said second direction from said second end of said shelf along a path past said second severing means to said envelope content separating station.

3. A device as in claim 2 in which said grasping means includes a vacuum cup having means for moving said vacuum cup from a normal position removed from said path to an engaged position in full abutment with said panel.

4. A device as in claim 3 including an optical detector directed to said path, for detecting the presence of the envelope and producing a control signal to actuate said cup movement means.

* * * * *